United States Patent [19]

Williams

[11] Patent Number: 4,830,291

[45] Date of Patent: May 16, 1989

[54] WASTE MATERIAL REVERSIBLE HAMMER MILL

[76] Inventor: Robert M. Williams, 16 La Hacienda, Ladue, Mo. 63124

[21] Appl. No.: 177,528

[22] Filed: Apr. 4, 1988

[51] Int. Cl.[4] ..... B02C 13/09

[52] U.S. Cl. ..... 241/73; 241/86; 241/88.2; 241/186.3; 241/189 A

[58] Field of Search ..... 241/189 A, 73, 79.2, 241/189 R, 86, 86.1, 87.1, 88.2, 88.3, 186.2, 186.3, 190

[56] References Cited

U.S. PATENT DOCUMENTS

| | | | |
|---|---|---|---|
| 2,411,302 | 11/1946 | Stine et al. | 241/189 A |
| 2,471,068 | 5/1949 | Keiper | 241/189 A |
| 2,767,929 | 10/1956 | West | 241/189 A |
| 2,973,909 | 3/1961 | Danyluke | 241/189 A |
| 2,977,055 | 3/1961 | Fawcett | 241/189 A |
| 4,009,836 | 3/1977 | Strom et al. | 241/189 A |
| 4,015,783 | 4/1977 | Miller | 241/73 |

*Primary Examiner*—Joseph M. Gorski

*Attorney, Agent, or Firm*—Gravely, Lieder & Woodruff

[57] ABSTRACT

A reversible downdraft rotary hammer mill for processing waste material in which breaker plates and a grate assembly are cooperatively arranged so the terminal ends of the grate assembly are laid back to form with the adjacent terminal ends of the breaker plates, when a terminal end of one breaker plate is opened relative to the tip circle of the rotary hammers and the other breaker plate is closed up to be adjacent the hammer tip circle, a tapering wedge shaped space for the opened breaker plate and a crushing surface for the closed up breaker plate. The cooperation of the breaker plates and the grate assembly enables the processing of a high volume of lightweight and fluffy material while avoiding plugging of the mill inlet.

7 Claims, 2 Drawing Sheets

FIG. 1.
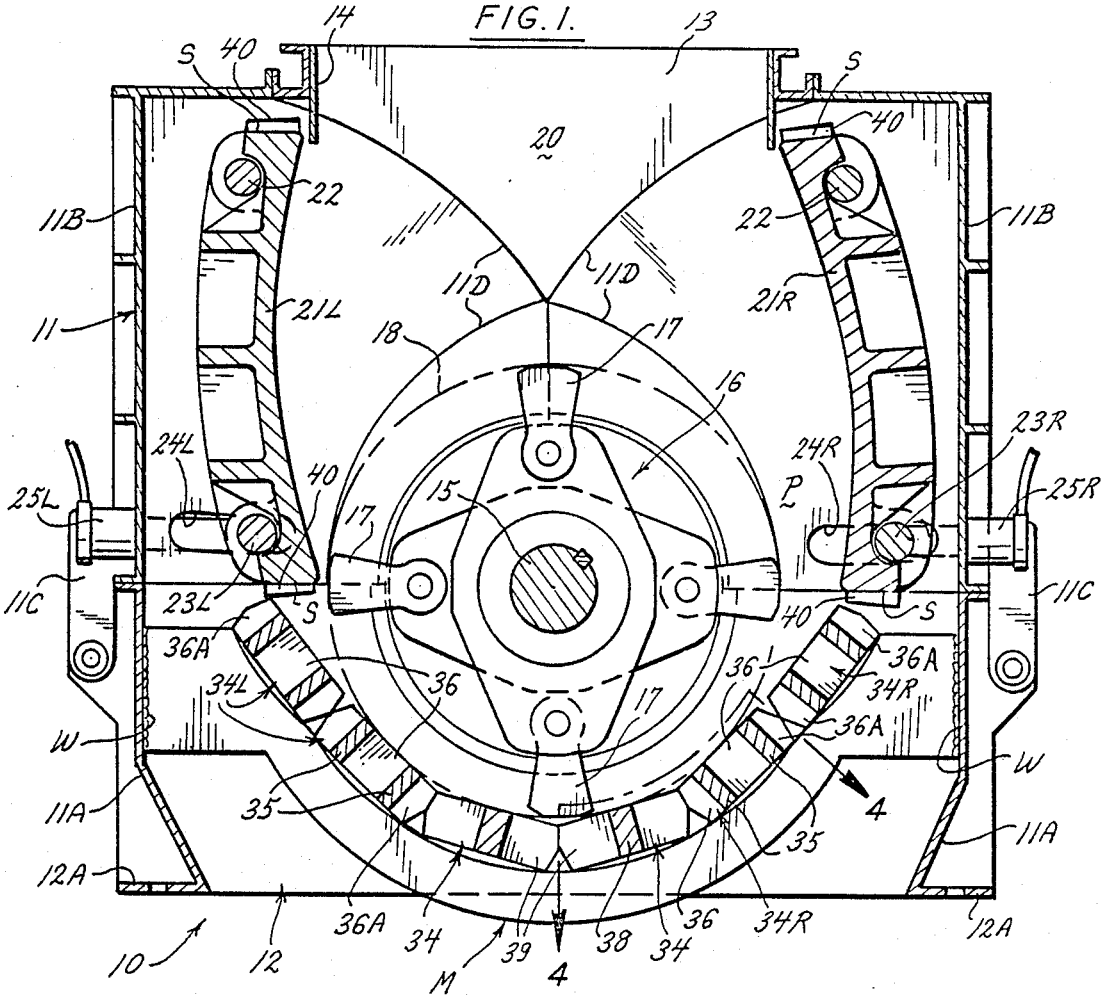
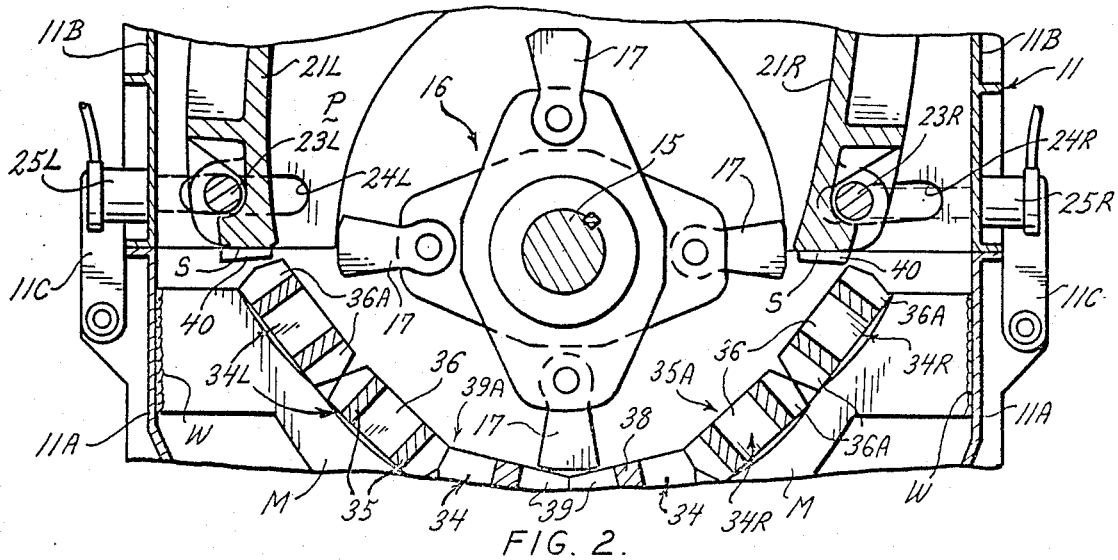
FIG. 2.

WASTE MATERIAL REVERSIBLE HAMMER MILL

RELATED APPLICATION

Related application of Robert M. Williams is Ser. No. 040,101 filed Apr. 20, 1987 as a C.I.P. of application Ser. No. 899,806 filed Aug. 25, 1986 (now abandoned).

BACKGROUND OF THE INVENTION

1. Field of the Invention

This invention relates to waste material hammer mills for disposing of waste material with a minimum of plugging of the inlet to the mill while developing a downdraft flow of air away from the mill inlet.

2. Description of the Prior Art

The prior art relating to waste material hammer mills has failed to consider the way the waste material fed to the mill is handled by rotary hammers in cooperation with breaker plates and a grate assembly which encompasses substantially one-half of the hammer circle. The prior art is represented by Williams U.S. Pat. No. 3,667,694 3,806,048, 4,245,790 and 4,399,085 and Strom et al U.S. Pat. No. 4,009,836. Secondary prior art references include Lemmon et al U.S. Pat. No. 2,482,279 and West U.S. Pat. No. 2,767,929.

It has been determined from actual tests that when the breaker plates and cage bars are arranged in a specific manner to be disclosed hereinafter, the waste material can be processed in large quantities without encountering plugging at the inlet, and without developing objectionable blow-back in line of flow toward the inlet which has heretofore developed due to the fan effect of the rotary hammers. Another prior art reference is the brochure of the Pennsylvania Crusher Division Bath Iron Works Corporation of West Chester, Pennsylvania which is advertised to be a mill that inhibits the escape of dust through the feed inlet to the mill.

SUMMARY OF THE INVENTION

The presently preferred embodiment of the invention resides in a reversible type rotary hammer mill having a central inlet opening and an axially aligned outlet with breaker plates pivotally mounted on opposite sides of the hammer rotor set between the inlet and outlet. The breaker plates extend from ends adjacent the inlet to terminal ends at opposite sides of the hammer rotor, and a grate assembly made up of grate bars with the bars at the opposite terminal ends of the grate assuming positioned for unique cooperation with the adjacent terminal ends of the breaker plates to enhance the disposing of waste material and to prevent plugging of the hammer mill.

A principal object of the present invention is to provide a reversible downdraft rotary hammer mill for processing waste material in which there is an arrangement of breaker plates and a grate assembly composed of separate bars such that the grate bars at the terminal ends of the grate assembly are bodily laid back from or are aligned so as to be tangent to the hammer circle, without regard to the direction of hammer rotation. The terminal ends of the breaker plates are shaped such that in opened positions spaced away from the hammer circle they form a tapering wedge space with the terminal ends of the grate bars, and in closed positions when moved up to the hammer circle, they present a strike surface projecting inwardly of the terminal end of the grate bars, and means for positioning the breaker plates relative to the terminal ends of the grate bars such that one breaker plate is moved in to position its strike surface adjacent the hammer circle and the opposite breaker plate is moved back to form the tapering wedge space.

Another object of the present invention is to utilize the breaker plate terminal ends and the grate bars at the terminal ends of the grate assembly in a first selective cooperative position to enhance the smooth and rapid feed of waste material by the rotary hammers toward the grate assembly for a given direction of rotation of the hammers while concurrently utilizing the terminal end of the opposite breaker plate as a strike surface for further crushing of the waste material.

A further object of the present invention is to provide a rotary hammer mill with an arrangement of cooperating breaker plates and grate bars that will form a passage between the inlet and outlet of the mill housing of a gradually tapering cross section for the purpose of being able to process a high volume of lightweight material that would, in a normal hammer mill, have a tendency to be slow in submitting to the impelling forces of the rotary hammer assembly for a direction of rotation to carry the lightweight material into the grinding orbit between the hammers and the grate bars, and in a mill of this characteristic which has the object to utilize the positioning breaker plates to establish the decreasing tapered passage of the material into the rotor and to utilize the positioning breaker plates to establish the decreasing tapered passage of the material into the rotor and to utilize an opposite breaker plate to present a serrated or toothed surface that will continue to effect material reduction and at the same time efficiently block any substantial flow of the lightweight material back toward the inlet so as to avoid establishing a plugging effect at the inlet to the mill.

BRIEF DESCRIPTION OF THE DRAWINGS

The present reversible hammer mill is shown in preferred forms in the accompanying drawings, wherein:

FIG. 1 is a vertical sectional view of the reversible hammer mill to illustrate the arrangement of the various components in one of its conditions of rotary hammer rotation for processing waste material;

FIG. 2 is a similar vertical sectional view of the reversible hammer mill to illustrate an arrangement of the various components when the rotary hammers are operated in a direction of rotation reverse to that in FIG. 1;

DETAILED DESCRIPTION OF THE EMBODIMENT

Figure 4:
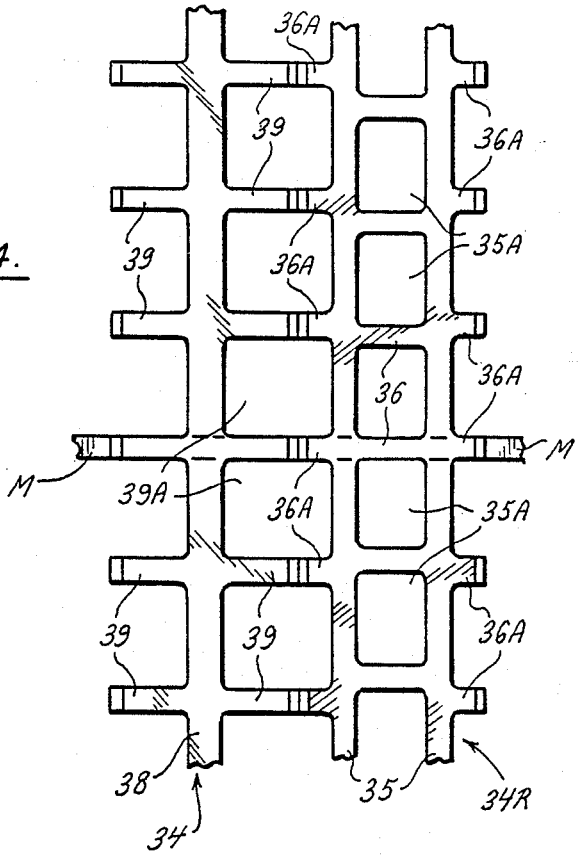
FIG. 4 is a flat plan view of the grate bar assembly as seen along the curved line 4—4 in FIG. 1

With reference to FIG. 1 there is seen a sectional elevational view of a typical hammer mill assembly 10 having a suitable casing 11 formed with a bottom opening 12 defined by and between lower wall portions 11A of the casing 11, and a base flange 12A. The casing is provided with an inlet opening 13 defined by the guide structure 14 which is centrally located and in vertical alignment with the rotary drive shaft 15 on which a rotary hammer assembly 16 is carried. The hammer elements 17 are pivotally connected to the assembly 16 and when the shaft 15 is rotated the hammer tips define a circular path of travel in which the tips of the hammers define a tip circle 18.

The inlet 13 of the mill casing 11 opens into a feed area 20 defined by and between a right hand breaker plate 21R and a left hand breaker plate 21L. The respective breaker plates are operatively mounted at their upper ends on pivot shafts 22 located in position relative to the inlet guide structure 14 so that the entry of material into the feed area 20 will be prevented from passing around the upper ends of the breaker plates 21R and 21L and getting into the space in the casing behind those breaker plates.

The mill casing 11 is constructed to have similar right and left casing sections 11B pivotally connected by suitable hinges 11C to the lower wall portions 11A of the casing 11. Each casing section 11B is formed with parting joints 11D such that on opening the casing the right and left breaker plates 21R and 21L are swung with the sections 11B out of the way to provide easy access to the rotary hammer assembly 16. Each casing section 11B carries with it, on being opened about the externally mounted hinges 11C, the breaker plates and operating means referred to as follows:

The lower or terminal end of the right breaker plate 21R receives a shaft 23R which extends across the width of the casing 11 and projects through the side walls at a slot 24R so that movement of the breaker plate 21R about its upper pivot shaft 22 moves along the slot 24R from the inner end of such a slot toward the outer end thereof. On the left hand side of the mill casing 11 the breaker plate 21L is similarly provided at its lower or terminal end with a shaft 23L that extends through the casing 11 so as to be able to move within the slot 24L as between the inner and outer ends of that slot. The right hand breaker plate shaft 23R is connected at its outwardly projecting ends to a hydraulic cylinder or other suitable drive means 25R, and the left hand breaker plate 21L is also operatively connected to suitable drive means 25L which may be a fluid pressure cylinder or other suitable drive means for moving the shaft 23L along the slot 24L.

Returning to FIG. 1, it is seen that the rotary hammer assembly 16 is partially circumscribed along the hammer circle 18 below the rotary drive shaft 15 by a series of grate bars 34. One of the bars 34R is in a laid back or tangent position to be cooperative with a toothed strike surface S on the lower end of the right hand breaker plate 21R, and an opposite laid back grate bar 34L is in a position to cooperate with the toothed strike surface S of breaker plate 21L. It is important in the present disclosure to recognize that each of the laid back or tangentially positioned grate bars 34R and 34L, (see FIG. 4) are constructed to have parallel ribs 35 and openings 35A so arranged that lateral ribs 36 are out of alignment with the teeth 36A except at a position substantially centrally of the length of the bar 34R. The bars 34, on the other hand, have a longitudinal rib 38 and side or lateral projections 39. The projections 39 on the rib 38 cooperate with the teeth 36A on the bars 34R to form openings 39A which are larger than openings 35A in the bar 34R. This difference in opening size means that the lateral projections 39 and teeth 36 forming openings 35A and 39A that are staggered except where the rib 36 and teeth 36A line up with the lateral projection 39A at only one place substantially near the center of the grate assembly between the ends thereof.

For purposes of the following description, it is seen in FIG. 1 that the breaker plate 21R, which is moved outwardly by the cylinders 25R, has its teeth 40 on strike surface S positioned opposite the teeth 36A on grate bar 34R and also spaced back from the hammer circle 18. This setting of the breaker plate 21R relative to the hammer assembly is intended to have a rotation in a clockwise direction so that the fan effect of the hammers carries the lightweight material entering the inlet 13 and in the feed area 20 down past the retracted end of the right hand breaker plate 21R. If the material is of a size to pass through the openings in the breaker bar 34L, the air flow with the material is free to pass out around the outside of and through the openings of the breaker bar 34L and into the outlet of the mill casing 12. At the left hand side of the assembly, the inward movement of the breaker plate 21L is very close to the hammer circle 18 so that the teeth 40 on strike surface S are off-set to the teeth 36, but surface S pinches off a substantial quantity of material which is crushed. Some of the material may be impelled upwardly across the feed area 20 to reenter the rotor rather than plug the inlet 13. What is happening during the clockwise rotation of the hammer assembly is that a negative pressure condition is created in the feed area 20 so that the air flow is sucked into the mill casing 11 and impelled outwardly around the grate bars and through the open bottom end 12 of the mill casing.

It is understood from FIG. 2 when breaker plate 21L is moved away from or retracted relative to the hammer circle 18, and the opposite breaker plate 21R is moved close into the hammer circle 18, the hammer assembly 16 is rotated in a counterclockwise direction in order that the reverse material reduction effect can duplicate the downdraft effect to maintain the pressure in the feed area 20 negative and pressure at the casing opening 12 positive. The view of FIG. 2 is essentially a duplicate of FIG. 1 but with the breaker plates moved to the opposite positions. Similar reference numerals have been applied for convenience so the need to fully describe FIG. 2 is avoided.

Figure 3:
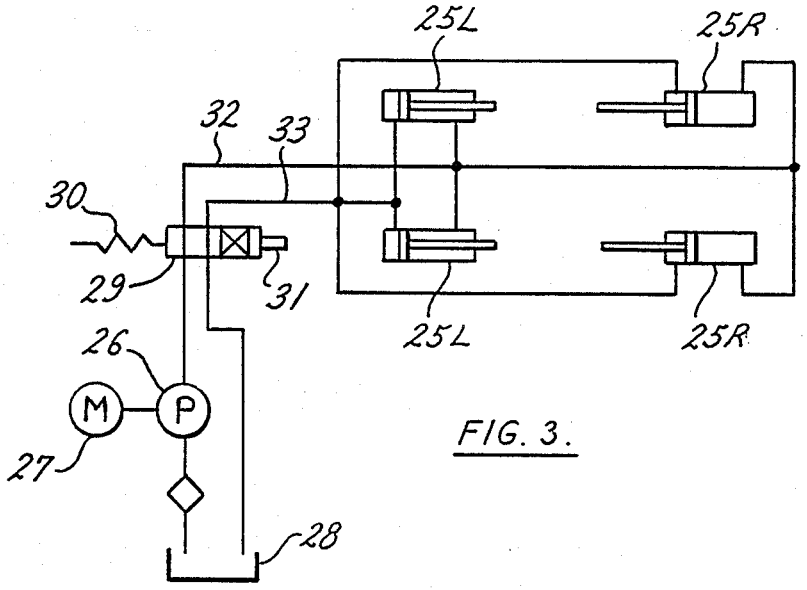
FIG. 3 is a schematic view of a control system for moving the breaker plates relative to the hammer tip circular path.

Turning now to FIG. 3, there is shown a schematic view of fluid pressure control means normally situated adjacent the mill 10 and connected up by flexible conduits for effecting the movement of the breaker plates 21R and 21L. It is understood, of course, that the shafts 23R and 23L extend through the opposite side walls of the mill casing 11 to the exterior thereof so that the cylinder means 25R and 25L may be suitably connected to the opposite ends of the shafts 23R and 23L for simultaneous movement of the respective breaker plates. In the view of FIG. 3 a hydraulic pump 26 driven by a motor 27, receives pressure fluid from a supply reservoir 28 and delivers the same through a reversing valve 29 which is responsive in one setting to a spring 30 and in an opposite setting to the energization of a solenoid 31. In this way, the supply conduit 32 and return conduit 33 can be reversed in function so that as one pair of cylinders 25R is energized to advance a breaker plate 21R toward the hammer circle 18 of the rotor assembly, the opposite pair of cylinders 25L are caused to move the breaker plate 21L back from the hammer circle 18. The respective positions of the breaker plates 21R and 21L are indicated in full line in FIG. 1, while the opposite setting with the breaker plate 21R withdrawing and the breaker plate 21L advanced, is understood to be opposite. It is understood in the schematic view of FIG. 3 that the solenoid 31 may be energized or deenergized as desired so as to shift the valve against the spring 30 or to allow the spring 30 to shift the valve for the purpose of simultaneously moving the breaker plates to one of the desribed positions.

Of special interest in the foregoing improvements to the reversible hammer mill is the arrangement on the strike surface S of each of the breaker plates 21R and 21L a series of teeth 40 which are spaced across the ends of each of the breaker plates and are aligned with the end teeth 36A which provide passages on the grate bars 34R and 34L so that the spaces between the aligned teeth 40 and 36A form an escape passage for the material which is being reduced by the hammer 17 in the rotary hammer assembly 16. In FIG. 1 the function of the teeth 40 and 36A is well illustrated for the rotation of the hammers 17 in a clockwise direction which will compel the incoming material to move into the wedge shaped passage P which continues below the breaker plate 21R and into the grate bars where escape openings 37 are formed. The laid back arrangement of the grate bar 34R allows the waste material to be forced through the grate opening for exit at the outlet 12 of the casing, thereby preventing what has been discovered in previous hammer mills of the hydraulic effect of a large mass of material trying to be forced through a narrow opening adjacent the lower end of the breaker plates. That hydraulic effect is particularly present when the waste material contains a high percentage of light weight material that tends to fluff up and reverse its movement back toward the inlet. By forming the wedge opening in the area of the laid back grate bars 34R the light weight material is readily entrained by the hammers 17 so that there is a substantial free flow of material below the bottom of the breaker plate. What has just been described for the breaker plate 21R and the laid back grate bar 34R for clockwise rotation of the hammers 17 can be duplicated by reversing the rotation of the hammers 17 in a counterclockwise direction upon the positioning of the breaker plate 21L in the proper position to form a similar wedge shaped passage into the grate bar 34L.

When one of the breaker plates is moved back from the hammer tip circle 18 the opposite breaker plate is moved inward so that the direction of rotation of the hammers carries the incoming material around the grate bars and upwardly to cause the material to crash into the teeth 40 on the breaker plate that is moved in because the teeth 40 on the end of the breaker plate are now exposed inwardly of the end teeth 36 on the laid back grate bars. The material that crashes into the inwardly moved end of the breaker plate still is able to escape through the spaces between the teeth 40 and 36 and into the outlet 12 of the casing.

In view of either FIG. 1 or FIG. 2, the wedge shaped passage previously referred to extends to a position which is substantially between 30° and 40° below the horizontal elevation through the center of the rotary shaft 15. It is also important to note that the teeth 40 on the bottom or lower edge of each of the breaker plates 21R and 21L are substantially in the horizontal elevation through the center of the shaft 15, thereby providing an escape route for the reduced material in the form of passages through the openings formed between the cooperating teeth 40 on the strike surface S of the breaker plates, in addition to the staggered openings formed in the grate bars themselves. These passages are formed between the provisions on the terminal ends of the grate bars and the cooperating terminal ends of the adjacent breaker plates without regard to the direction of the rotation of the rotary hammer assembly.

A further improvement in the reversible hammer mill heretofore shown in FIG. 1 is depicted in a flat plan view of FIG. 4 seen along the line 4—4 in FIG. 1. It has been found important to maintain the proper curvature of the grate bar assembly to provide a support member M that is centrally located between the axial ends of the grate bar assembly so as to extend widthwise between the side walls 11A of the mill casing 11. The member is located so it does not become exposed in any of the grate openings to present a curved surface which acts as a saddle or support for the grate bar assembly. That saddle member is provided with enlarged opposite ends that are secured by welding W to the side walls 11A.

It should now be apparent that the present embodiment of the invention relates to a downdraft reversible hammer mill 10 having a casing 11 formed with a centrally located material inlet 13 and an opposite bottom outlet 12. A rotary hammer assembly 16 operably mounted in the casing rotates in either direction and can describe a circular path 18 of the tips of the hammer elements. A semicircular assembly of a plurality of grate bars 34 circumscribes substantially one-half or the lower part of the circular path 18 of the tips of the hammer elements 16. Breaker plates 21R and 21L are spaced apart and having pivots 22 at the upper ends adjacent the casing inlet 13 and lower terminal ends to cooperate with the adjacent terminal ending bars 34R and 34L. It is noted that the opposite ends of the breaker plates have teeth 40 to make them reversible end for end.

In view of the foregoing details of the presently preferred embodiments of the invention, it can be appreciated that the improvement comprises an arrangement in a hammer mill having a casing formed with a material inlet 13 and a ground product outlet 12 and a rotary shaft 15 in the casing carrying a rotor assembly having hammer elements 16 which describe a hammer tip circle 18 comprising a grate assembly in the casing defining a semicircular surface having terminal end surfaces which deviate from the circle of the semicircular surface to present surface positions directed substantially tangential to the semicircular surface, elongated breaker plates in the casing at opposite sides of the rotor assembly to present inner surfaces to the hammer elements of the rotor assembly and with ends thereon formed with toothed strike surfaces S presented to and cooperating with the terminal ends of the grate assembly. Operable means 25R and 25L are connected to the breaker plates 21R and 21L respectively for selectively positioning the breaker plates, as in FIG. 1, with one breaker plate moved in toward the tip circle so as to expose its strike surface adjacent to the hammer tip circle while the opposite breaker plate is moved outwardly from the hammer tip circle to substantially align its inner surface with the adjacent terminal end surface on the grate assembly.

This improvement establishes, for clockwise rotation of the hammer assembly, an arrangement in which the incoming material to be reduced can be moved by the hammers 17 into substantially uninterrupted wedge shaped path P (see FIG. 1) which decreases in cross section as the path continues past the horizontal level of the terminal end of the grate assembly at each side of the rotor assembly. This gradually decreasing path continues down to about 30° to 40° below the horizontal level of the terminal ends 34R and 34L of the grate assembly. Concurrently the opposite breaker plate 21L is such that it has been moved inwardly to expose the strike surface S with its teeth 40 thereon inside of the terminal end of the grate bar 34L. The material carried by the rotary hammers 17 is further crushed and reduced against the toothed strike surface S. A certain portion of the material passes the strike surface S and the teeth 40 on the inwardly moved breaker plate and is carried by the hammers 17 in a direction tangentially across the material receiving area 20 in the casing so as not to interfere with, but be comingled with and essentially carried with the incoming material at the inlet 13 back to the path P. The foregoing description is applicable to the arrangement where the breaker plates are selectively moved in and out depending on the direction of rotation of the rotor assembly for accomplishing the improvement of this invention. What has been described for clockwise hammer rotation is, of course, duplicated for counter clockwise hammer rotation.

Having described presently preferred embodiments of downdraft reversible hammer mills, it is understood that the disclosure may suggest other modifications of a character that will be within the scope of the foregoing description.

What is claimed is:

1. In a hammer mill having a casing formed with a material inlet and an outlet for a reduced material, and a rotary shaft in the casing carrying a rotor assembly having hammer elements which describe a hammer tip circle between the inlet and the outlet, the improvement comprising:

(a) a grate assembly mounted in the casing and extending across the casing outlet, said grate assembly defining a semicircular surface having terminal end surfaces which deviate from the circularity of the semicircular surface to present grate surfaces in positions directed substantially tangential to said semicircular surface, said grate assembly having openings for the passage of material when reduced;

(b) elongated breaker plates mounted in the casing at opposite sides of the material inlet and extending into positions at opposite sides of said rotor assembly, each of said plates having inner surfaces exposed to the incoming material and the hammer tip circle of the rotor assembly, said breaker plates having terminal ends formed with toothed strike faces that cooperate with and are presented toward the terminal end surfaces of said grate assembly; and (c) means operably connected to said breaker plates for selectively positioning said breaker plates with one breaker plate positioned with its toothed strike face moved inwardly toward the hammer tip circle so that this toothed strike face is spaced closer to the hammer tip circle than its cooperating terminal end surface of said grate assembly and is exposed to the movement of material moved adjacent to the hammer tip circle, and an opposite breaker plate positioned with its toothed strike face moved outwardly away from the hammer tip circle so that its toothed strike face is substantially aligned with its cooperating terminal end surface of the grate assembly.

2. The improvement in a hammer mill set forth in claim 1 wherein the selective positioning of said one breaker plate inwardly with its toothed strike face exposed adjacent the hammer tip circle corresponds for rotation of the hammer elements to carry waste material against said exposed face to augment the material reduction in the mill casing.

3. The improvement in a hammer mill set forth in claim 1 wherein the selective positioning of said opposite breaker plate outwardly away from the hammer tip circle forms a wedge shaped passage having a terminal end that extends into said grate assembly past said deviated terminal end to guide the material between said hammer elements and said grate assembly.

4. In a waste material reducing hammer mill, the combination with a casing having an upper waste material inlet to the casing and a reduced material outlet spaced below said inlet, of:

(a) a rotary hammer assembly operative in said casing between said inlet and outlet, said hammer assembly defining a hammer tip circle;

(b) a grate assembly mounted in said casing outlet below said hammer assembly and presenting a curved surface adjacent a semicircular portion of said hammer tip circle, said grate assembly having openings for the passage of material when reduced and having terminal ends directed substantially tangentially to the hammer tip circle at opposite ends of said curved surface;

(c) breaker plates mounted in said casing at opposite sides of said rotary hammer assembly and having surfaces extending from ends of the breaker plates adjacent said casing inlet to opposite ends of the breaker plates directed toward said terminal ends of said grate assembly, said breaker plate opposed ends being horizontally opposite to each other, relative to said hammer assembly, and having toothed strike faces presented toward and adjacent to said grate terminal ends, respectively; and (d) means connected to said breaker plates for positioning one of said breaker plates with its toothed strike face in cooperative alignment with its adjacent grate terminal end to provide a passage having a gradually decreasing cross section for material to be reduced, said means positioning another breaker plate with its toothed strike face positioned inwardly of its adjacent terminal end of said grate assembly so as to be adjacent the hammer tip circle for exposure to the material entrained by said hammer assembly for further reduction, both of said toothed strike faces cooperating with said terminal ends of said grate assembly to form therebetween escape passages for the reduced material to flow to said casing outlet.

5. The waste material reducing hammer mill recited in claim 4 wherein said terminal ends of said grate assembly present tooth projections in cooperating alignment with said breaker plate toothed strike faces which project into said escape passages for material being reduced by said hammer assembly.

6. The waste material reducing hammer mill recited in claim 4 wherein said breaker plate surfaces presented to said rotary hammer assembly are curved to form an initial gradually decreasing tapered passage with said rotary hammer assembly as said one of said breaker plates extends toward one of said terminal ends of said grate assembly, said gradually decreasing tapered passage formed by said one breaker plate with its toothed strike face aligned with its adjacent grate terminal end continuing to extend into said grate assembly below said horizontally opposed opposite ends of said breaker plates.

7. In a waste material reducing hammer mill, the combination comprising:

(a) a casing structure having a waste material inlet and an outlet for reduced waste material;

(b) a rotary hammer assembly mounted in said casing between said inlet and outlet, said hammer assembly describing a hammer tip circle;

(c) a grate assembly mounted between said hammer assembly and said outlet, said grate assembly having a curved configuration substantially matching said hammer tip circle and having opposite terminal end portions that deviate from the hammer tip circle to expose a tapering space extending into said grate assembly between said grate assembly and the hammer tip circle at the respective ends of said grate assembly, said terminal ends having toothed projections thereon;

(d) breaker plates mounted in said casing and extending from adjacent said inlet to terminal ends horizontally opposed to each other on opposite sides of said hammer assembly, said breaker plate terminal ends approach said terminal end portions of said grate assembly, said breaker plate terminal ends having strike surfaces formed with projecting teeth that cooperate with said tooth projections on said terminal portions of said grate assembly to provide spaces for the passage of reduced material to said casing outlet; and (e) means operably connected to said breaker plates to position said plates selectively with one plate moved into adjacency to the hammer tip circle so that the projecting teeth thereof are spaced closer to the hammer tip circle than the toothed projections of the grate assembly with which they cooperate, and so that its strike surface is exposed to material being impelled by said hammer assembly to be reduced, and with another plate moved to cooperate with a terminal end portion of said grate assembly to expose a tapered space with said hammer tip circle.

* * * * *

UNITED STATES PATENT AND TRADEMARK OFFICE

CERTIFICATE OF CORRECTION

PATENT NO. : 4,830,291

DATED : May 16, 1989

INVENTOR(S) : Robert M. Williams

It is certified that error appears in the above-identified patent and that said Letters Patent is hereby corrected as shown below:

Col. 1, line 23, "4,399,085" should be "4,339,085";

Signed and Sealed this

Twenty-first Day of April, 1992

*Attest:*

HARRY F. MANBECK, JR.

*Attesting Officer*

*Commissioner of Patents and Trademarks*